US006966452B2

(12) United States Patent
Kim

(10) Patent No.: US 6,966,452 B2
(45) Date of Patent: Nov. 22, 2005

(54) PHARMACEUTICAL TABLET DISPENSING AND PACKAGING SYSTEM

(76) Inventor: Jun Ho Kim, 100-23, Galsandong, Dalsuhgu, Daegu (KR)

( * ) Notice: Subject to any disclaimer, the term of this patent is extended or adjusted under 35 U.S.C. 154(b) by 250 days.

(21) Appl. No.: 10/605,073

(22) Filed: Sep. 6, 2003

(65) Prior Publication Data

US 2004/0112911 A1 Jun. 17, 2004

(30) Foreign Application Priority Data

Sep. 6, 2002 (KR) ..... 20-2002-0026793 U

(51) Int. Cl.[7] ..... B65H 1/00
(52) U.S. Cl. ..... 221/133; 312/42
(58) Field of Search ..... 221/133, 124, 221/131, 119, 130, 289; 312/42, 35, 60

(56) References Cited

U.S. PATENT DOCUMENTS 5,509,573 A * 4/1996 Campoli ..... 221/133
5,901,876 A 5/1999 Yuyama et al.
6,145,700 A 11/2000 Takashima et al.
6,585,132 B2 * 7/2003 Kim ..... 221/133

* cited by examiner

*Primary Examiner*—Kenneth Noland
(74) *Attorney, Agent, or Firm*—Park & Sutton LLP; John K. Park

(57) ABSTRACT

A pharmaceutical tablet dispensing and packaging system comprising a packaging unit, a first dispensing unit above the packaging unit and defined by a front portion, a rear portion and side portions where tablet cassettes containing tablets are installed in the dispensing unit detachably through the front portion and aligned in columns to selectively release the tablets through the rear portion into the tablet packaging unit, a second dispensing unit mirrored and hinged to the first dispensing unit to form spatial shafts by corresponding grooves of the dispensing units, and a hopper disposed beneath the dispensing units into the tablet packaging unit. Vertical dividers are formed on the rear portion to incorporate the vertical grooves between and by the dividers and each rear side of the tablet cassettes.

12 Claims, 4 Drawing Sheets

PHARMACEUTICAL TABLET DISPENSING AND PACKAGING SYSTEM

CROSS REFERENCE TO RELATED APPLICATIONS

The applicant claims and requests a foreign priority, through the Paris Convention for the Protection of Industry Property, based on a patent application filed in the Republic of Korea (South Korea) with the filing date of Sep. 6, 2002, with the application number 20-2002-0026793, by the applicant.

BACKGROUND OF INVENTION

The invention relates to a pharmaceutical automation system. More particularly, the present invention relates to a pharmaceutical tablet dispensing and packaging system which facilitates cleaning of tablet channels through which tablets are released for tablet packaging.

In order to increase capacity for housing the tablet cassettes, a flat type cabinet or a cylindrical type cabinet have been widely adopted to stack therein as many tablet cassettes as the system allows. Each tablet in the tablet cassettes comes to fall through a tablet channel into a tablet packaging portion. So each tablet channel inevitably holds on its wall either dusts or debris out of the dropping tablets. A tiny amount of tablet debris may result in medical care for a patient taking tablets packaged through the conventional tablet dispensing and packaging system. FIG. 9 shows a conventional swingable tablet cassette cabinet 2 that results in difficulty cleaning tablet channels 4 between tablet cassettes 6 for tablets to fall from the cassettes.

A demand is to construct a system having a mechanism by which the tablet channels can be easily cleaned.

SUMMARY OF INVENTION

Accordingly, an object of the present invention is to provide a pharmaceutical tablet dispensing and packaging system that facilitates cleaning of tablet channels through which tablets are dropped into a tablet packaging unit.

Another object of the present invention is to substantially increase product reliability by minimizing possibility that unwanted dusts or debris from other sources may be contained in a prescription tablet bag.

A further object of the present invention is to substantially increase capacity of housing tablet cassettes in the system while facilitating management efficiency of the system.

To achieve these and other objects, a pharmaceutical tablet dispensing and packaging system according to the present invention comprises a tablet packaging unit. A first tablet dispensing unit is disposed on top of the tablet packaging unit and defined by a front portion, a rear portion and side portions. First tablet cassettes each containing tablets are installed in the first tablet dispensing unit detachably through the front portion and aligned in columns to selectively release the tablets through the rear portion into the tablet packaging unit. A plurality of vertical dividers are formed on the rear portion to incorporate a plurality of vertical grooves between and by the dividers and each rear side of the tablet cassettes.

A second tablet dispensing unit is substantially shaped in mirror image to and hinged sidewise to the first tablet dispensing unit so that when the dispensing units are hingedly closed a plurality of spatial shafts are formed by the corresponding grooves of the dispensing units to serve as downward channels through which the cassette-released tablets fall toward the tablet packaging unit. A hopper disposed beneath the dispensing units into the tablet packaging unit to guide the cassette-released tablets down into the tablet packaging unit for tablet packaging.

In an embodiment, a front cabinet is disposed on top of the tablet packaging unit, and front tablet cassettes each containing tablets are mounted in the front cabinet to selectively release the tablets to the tablet packaging unit. In this mechanism, the first tablet dispensing unit is hinged to the front cabinet. The system further comprises a locking member to improve closure of the dispensing units when required. The locking member is formed on the side portions opposing the hinged side portions. A hamper formed through the hinged side portions of the dispensing units to soften the hinged opening and the hinged closing of the dispensing units.

The dividers are flat and wider than the grooves, and one of the first and second dispensing units may be fixed to the tablet packaging unit. The tablet packaging unit comprises a printer to print respective information on a packaging paper, and a heater assembly to package the tablets released through the hopper into one or more partitioned paper bags using the packaging paper.

The advantages of the present invention are numerous in that: (1) the dividable mechanism of the tablet channels enables a pharmacist or system operator to easily clean the tablet channels by simply detaching (opening) the paired tablet dispensing cabinets from each other, thereby improving product reliability; (2) the paired tablet dispensing cabinets establish a visual notice mechanism as to when to clean the tablet channels, thus improving system management efficiency; and (3) the paired tablet dispensing cabinets enable a fast trek cleaning of the tablet channels, compared to the conventional tablet cabinet system, using a known vacuum cleaning tool, thereby enhancing customer satisfaction.

Although the present invention is briefly summarized, the fuller understanding of the invention can be obtained by the following drawings, detailed description and appended claims.

BRIEF DESCRIPTION OF DRAWINGS

These and other features, aspects and advantages of the present invention will become better understood with reference to the accompanying drawings, wherein.

DETAILED DESCRIPTION

Figure 2:
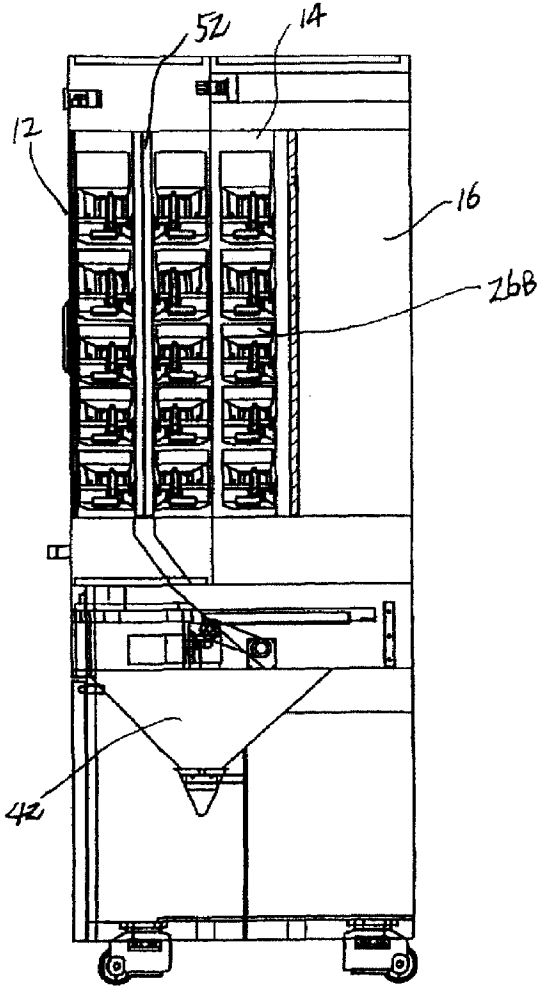
FIG. 2 is a side view of FIG. 1.
Figure 1:
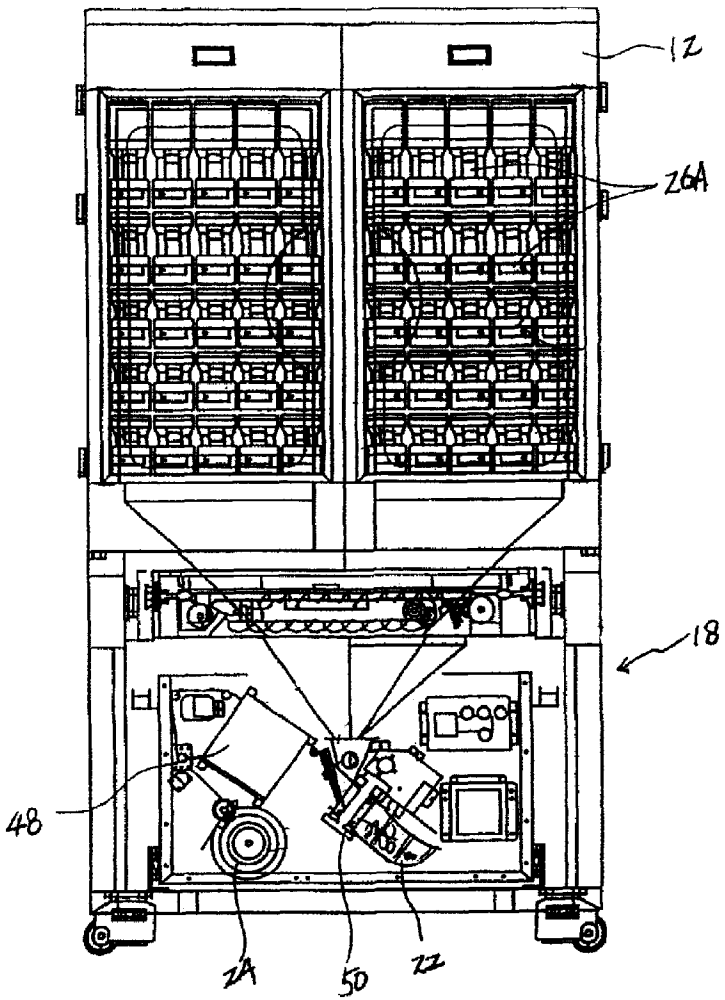
FIG. 1 is a front view of a pharmaceutical tablet dispensing and packaging system according to the present invention.
Figure 3:
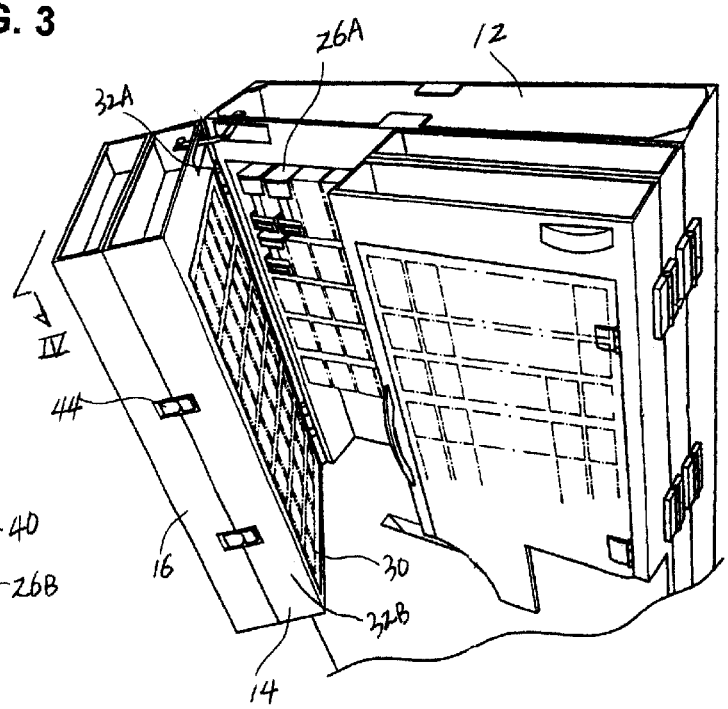
FIG. 3 is a perspective view showing closing of tablet dispensing units according to the present invention.
Figure 4:
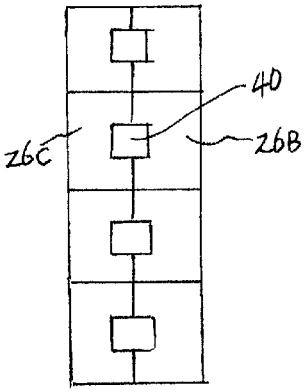
FIG. 4 is a cross-sectional view taken along line IV in FIG. 3.
Figure 5:
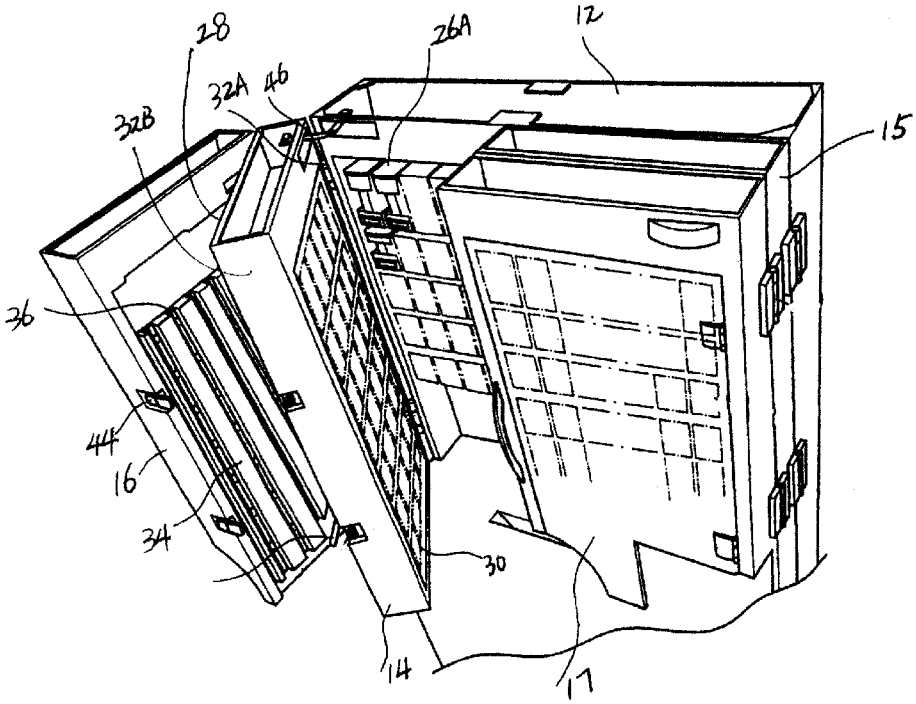
FIG. 5 is a perspective view showing opening of the tablet dispensing units of FIG. 3.
Figure 6:
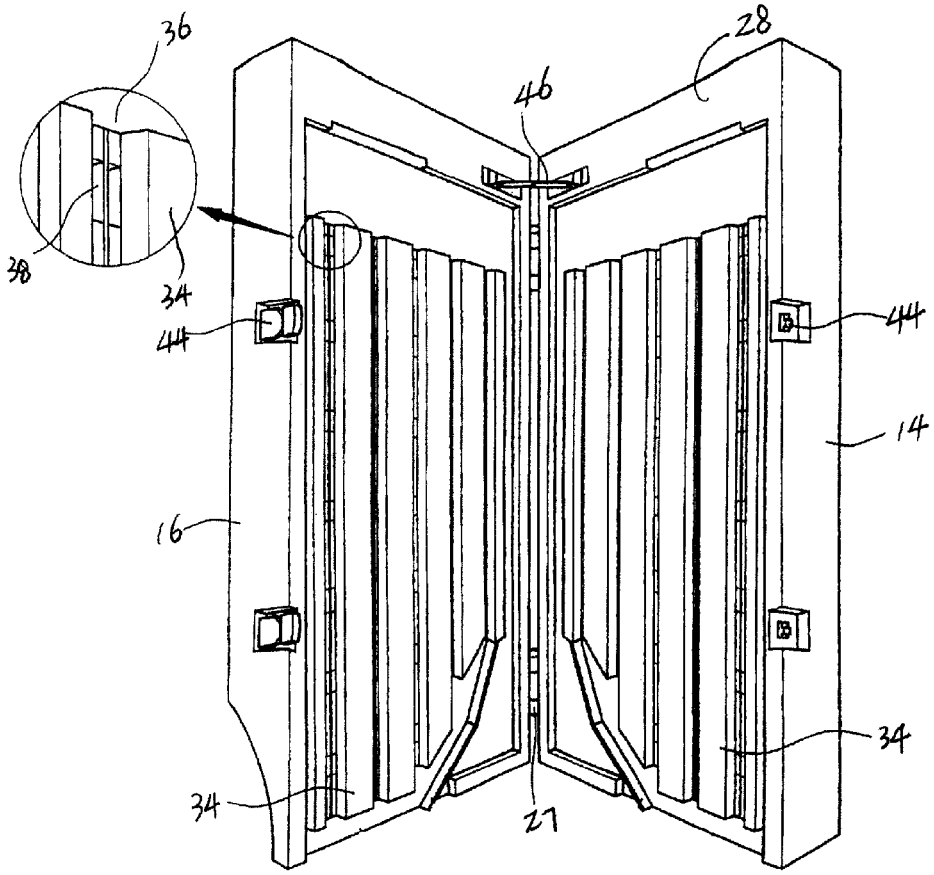
FIG. 6 is a view showing opening of the tablet dispensing units according to the present invention.
Figure 7:
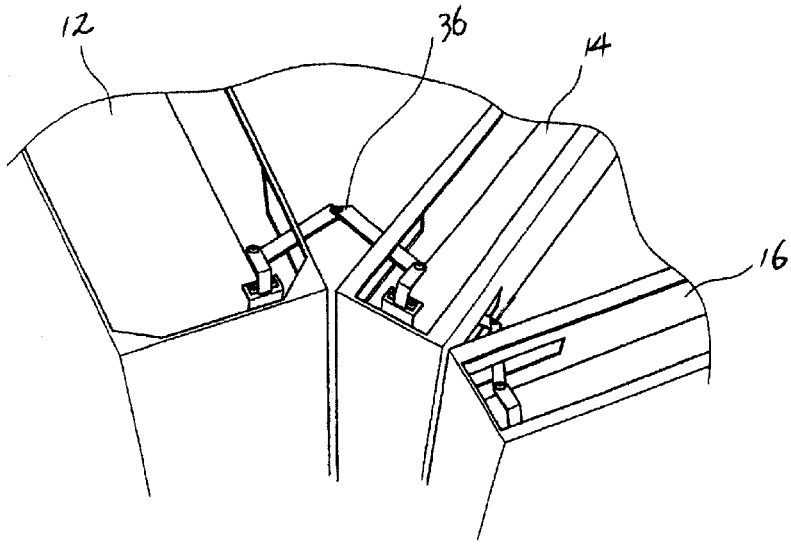
FIG. 7 is a view showing damper mechanism in FIG. 5.
Figure 8:
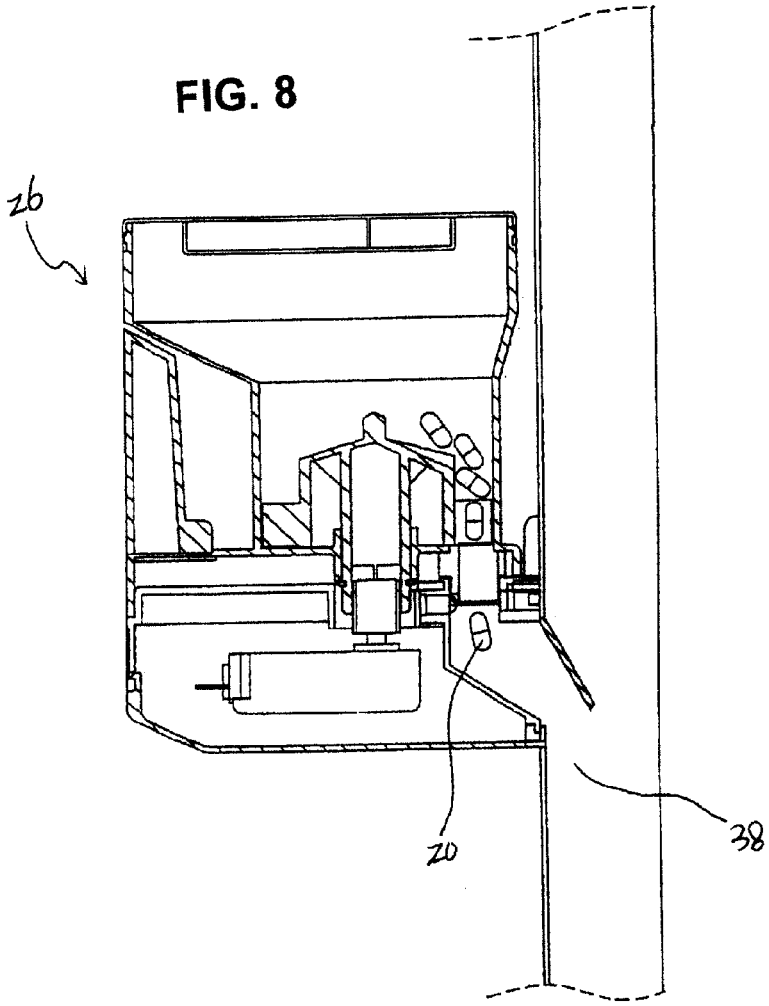
FIG. 8 is a view showing tablet cassette according to the present invention.
Figure 9:
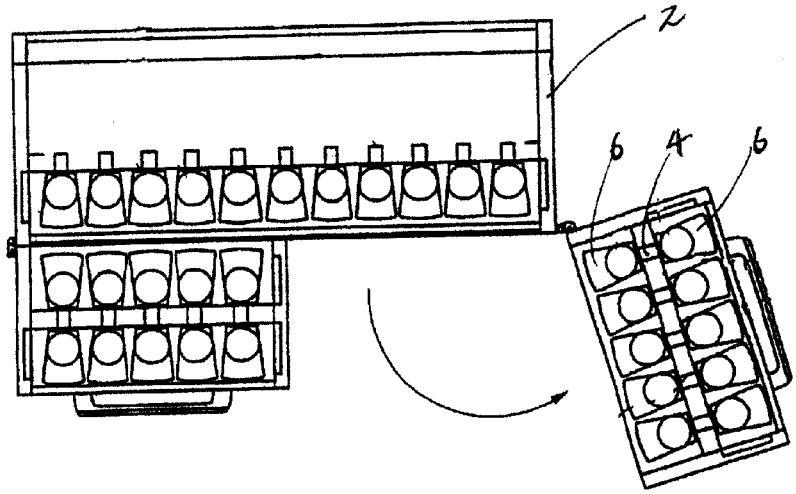
FIG. 9 PRIOR ART
FIG. 9 is a view showing cassette cabinet operation in the prior art. </paragraph>

FIGS. 1 and 2 each show front and side view of a pharmaceutical tablet dispensing and packaging system 10 according to the present invention. FIGS. 3–7 each show operation mechanism of a base cabinet 12, first and second tablet dispensing units 14, 16. FIG. 8 shows a tablet releasing mechanism according to the present invention. As shown therein, the tablet dispensing and packaging system 10 includes a tablet packaging unit 18 at a lower portion of the system 10. The tablet packaging unit 18 is provided to package tablets 20 each released from cabinet 12 and/or dispensing units 14, 16 into paper bags 22 using a packaging paper 24 so as for a patient to take prescription drug in convenience without prying caps of tablet containers. A plurality of tablet cassettes 26 are detachably aligned in columns and rows in the cabinet 12 and the dispensing units 14, 16 to selectively release tablets 20 therein down to the tablet packaging unit 12 for tablet packaging.

The front cabinet 12 is disposed on top of the tablet packaging unit 18. A group of tablet cassettes 26A are installed in the cabinet 12 and another group of tablet cassettes 26B are installed in the tablet dispensing units 14, 16. Front tablet cassettes 26A each contain a predetermined type of tablets 20 and are detachably mounted in the front cabinet 12 to selectively release the tablets 20 to the tablet packaging unit 18. The first tablet dispensing unit 14 is hinged to the front cabinet 12 by hinges 27 and defined by a front portion 28, a rear portion 30 and side portions 32. Also, the tablet cassettes 26B each contain tablets 20 and are installed in the first tablet dispensing unit 14 detachably through the front portion 28 and aligned in columns and rows to selectively release the tablets 20 through the rear portion 30 down into the tablet packaging unit 18.

For a better performance, a plurality of vertical dividers 34 are formed on the rear portion 28 to incorporate a plurality of vertical grooves 36 between and by the dividers 34 and each rear side 38 of the tablet cassettes 26B. Here, tablets 20 become selectively released through the rear side 38 of each tablet cassette 26 under the command of a controller (not shown). Meanwhile, a second tablet dispensing unit 16 is substantially shaped in mirror image to and hinged sidewise to the first tablet dispensing unit 14 so that when the dispensing units 14, 16 are hingedly closed, a plurality of spatial shafts 40 are formed by the corresponding grooves 36 of the dispensing units 14, 16 to serve as downward channels through which the cassette-released tablets 20 fall toward the tablet packaging unit 18.

That is, when the dispensing units 14, 16 are hingedly closed to abut on each other, the spatial shafts 40 are formed by each corresponding pair of the grooves 36 of the dispensing units 14, 16, whereby the tablets 20 selectively released through each rear side 38 of the tablet cassette 26B in the dispensing units 14, 16 become dropped down through the spatial shafts 40 into the tablet packaging unit 18. At the same time, the cleaning of the spatial shafts 40 can be easily implemented by simply opening the closed dispending units 14, 16 and by subsequently dividing the spatial shafts 40 back to the grooves 36. In particular, when the tablets 20 are in whole pill type rather than in granule-contained capsule type, it is required to clean the tablet channels through which different types of tablets 20 pass because tiny debris of tablets 20 may cause a negative effect on the patient.

A hopper 42 is disposed beneath the dispensing units 14, 16 and the cabinet 12 into the tablet packaging unit 18 to guide the released tablets 20 down into the tablet packaging unit 18 for tablet packaging. The system 10 further comprises a locking member 44 to improve closure of the dispensing units 14, 16 when required, and a hamper 46 to soften the hinged opening and the hinged closing of the dispensing units 14, 16 and the cabinet 12. The locking member 44 is formed on the side portions 32B opposing the hinged side portions 32A. The hamper 46 is formed through the hinged side portions 32A, 32B of the dispensing units 14, 16 and the front cabinet 12. The system 10 may further comprise third and fourth tablet dispensing units 15, 17 each shaped in mirror image to the first and second tablet dispensing units 14, 16. In the same mechanism as in the first and second dispensing units 14, 16, the third tablet dispensing unit 15 is hinged to the front cabinet 12 to oppose the first tablet dispensing unit 14.

In a preferred version, the dividers 34 are formed flat and wider than the grooves 36. The front cabinet 12 is preferably fixed to the tablet packaging unit 18. The tablet packaging unit 18 comprises a printer 48 to print respective information on the packaging paper 24, and a heater assembly 50 to package the tablets 20 released through the hopper 42 into one or more partitioned paper bags 22 using the packaging paper 24. The front cabinet 12 comprises a plurality of upright tablet passages 52 to facilitate tablet guidance from the tablet cassettes 26A of the cabinet 12 into the hopper 42. Also, when the front cabinet 12 is not provided, one of the first and second dispensing units 14, 16 is fixed to the tablet packaging unit 18.

As discussed above, an advantage of the pharmaceutical tablet dispensing and packaging system 10 is the dividable mechanism of the tablet channels or the spatial shafts 40 enables a pharmacist or system operator to easily clean the tablet channels by simply detaching (opening) the paired tablet dispensing units 14, 16 from each other, thereby improving product reliability. Further, the paired tablet dispensing units 14, 16 establish a visual notice mechanism as to when to clean the tablet channels, thus improving system management efficiency. In addition, the paired tablet dispensing units 14, 16 enable a fast trek cleaning of the tablet channels, compared to the conventional tablet cabinet system, using a known vacuum cleaning tool, thereby enhancing customer satisfaction.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A pharmaceutical tablet dispensing and packaging system, comprising:

a) a tablet packaging unit;

b) a first tablet dispensing unit disposed on top of the tablet packaging unit and defined by a front portion, a rear portion and side portions, wherein first tablet cassettes each containing tablets are installed in the first tablet dispensing unit detachably through the front portion and aligned in columns to selectively release the tablets through the rear portion into the tablet packaging unit, wherein a plurality of vertical dividers are formed on the rear portion to incorporate a plurality of vertical grooves between and by the dividers and each rear side of the tablet cassettes;

c) a second tablet dispensing unit substantially shaped in mirror image to and hinged sidewise to the first tablet dispensing unit so that when the dispensing units are hingedly closed a plurality of spatial shafts are formed by the corresponding grooves of the dispensing units to serve as downward channels through which the cassette-released tablets fall toward the tablet packaging unit; and d) a hopper disposed beneath the dispensing units into the tablet packaging unit to guide the cassette-released tablets down into the tablet packaging unit for tablet packaging.

2. The system of claim 1 further comprising:

a) a locking member to improve closure of the dispensing units when required, wherein the locking member is formed on the side portions opposing the hinged side portions;

b) a hamper formed through the hinged side portions of the dispensing units to soften the hinged opening and the hinged closing of the dispensing units.

3. The system of claim 1 wherein the dividers are flat and wider than the grooves.

4. The system of claim 1 wherein one of the first and second dispensing units is fixed to the tablet packaging unit.

5. The system of claim 1 wherein the tablet packaging unit comprises:

a) a printer to print respective information on a packaging paper; and b) a heater assembly to package the tablets released through the hopper into one or more partitioned paper bags using the packaging paper.

6. The system of claim 1 wherein the dividers are flat and wider than the grooves.

7. The system of claim 1 wherein the front cabinet is fixed to the tablet packaging unit.

8. The system of claim 1 wherein the tablet packaging unit comprises:

a) a printer to print respective information on a packaging paper; and b) a heater assembly to package the tablets released through the hopper into one or more partitioned paper bags using the packaging paper.

9. The system of claim 1 wherein the front cabinet comprises a plurality of upright tablet passages to facilitate tablet guidance from the tablet cassettes of the cabinet into the hopper.

10. A pharmaceutical tablet dispensing and packaging system, comprising:

a) a tablet packaging unit;

b) a front cabinet disposed on top of the tablet packaging unit, wherein front tablet cassettes each containing tablets are mounted in the front cabinet to selectively release the tablets to the tablet packaging unit;

c) a first tablet dispensing unit hinged to the front cabinet and defined by a front portion, a rear portion and side portions, wherein first tablet cassettes each containing tablets are installed in the first tablet dispensing unit detachably through the front portion and aligned in columns to selectively release the tablets through the rear portion into the tablet packaging unit, wherein a plurality of vertical dividers are formed on the rear portion to incorporate a plurality of vertical grooves between and by the dividers and each rear side of the tablet cassettes;

d) a second tablet dispensing unit substantially shaped in mirror image to and hinged sidewise to the first tablet dispensing unit so that when the dispensing units are hingedly closed a plurality of spatial shafts are formed by the corresponding grooves of the dispensing units to serve as downward channels through which the cassette-released tablets fall toward the tablet packaging unit;

e) a hopper disposed beneath the dispensing units and the cabinet into the tablet packaging unit to guide the released tablets down into the tablet packaging unit for tablet packaging.

11. The system of claim 10 further comprising:

a) a locking member to improve closure of the dispensing units when required, wherein the locking member is formed on the side portions opposing the hinged side portions;

b) a hamper formed through the hinged side portions of the dispensing units and the front cabinet to soften the hinged opening and the hinged closing of the dispensing units.

12. The system of claim 10 further comprising third and fourth tablet dispensing units each shaped in mirror image to the first and second tablet dispensing units, wherein the third tablet dispensing unit is hinged to the front cabinet to oppose the first tablet dispensing unit.

* * * * *